US006463847B1

(12) United States Patent
Rauch

(10) Patent No.: US 6,463,847 B1
(45) Date of Patent: Oct. 15, 2002

(54) HOOP-CASING DEVICE

(75) Inventor: Manfred Rauch, Sasbach (DE)

(73) Assignee: Fromm Holding AG (CH)

( * ) Notice: Subject to any disclaimer, the term of this patent is extended or adjusted under 35 U.S.C. 154(b) by 0 days.

(21) Appl. No.: 09/463,288

(22) PCT Filed: Jun. 18, 1998

(86) PCT No.: PCT/CH98/00245

§ 371 (c)(1),
(2), (4) Date: Jun. 21, 2000

(87) PCT Pub. No.: WO99/05025

PCT Pub. Date: Feb. 4, 1999

(30) Foreign Application Priority Data

Jul. 30, 1997 (CH) ..... 1780/97

(51) Int. Cl.[7] ..... B65B 13/32

(52) U.S. Cl. ..... 100/29; 53/589; 100/32; 100/33 PB

(58) Field of Search ..... 100/29, 32, 33 PB; 53/589

(56) References Cited

U.S. PATENT DOCUMENTS 3,269,300 A * 8/1966 Billett et al. ..... 100/33 PB
3,944,460 A 3/1976 Karr
4,016,023 A * 4/1977 Takami ..... 100/33 PB
4,288,270 A * 9/1981 Mossell et al. ..... 100/33 PB
4,502,911 A * 3/1985 Discavage ..... 100/33 PB
4,527,379 A * 7/1985 Bartzick et al. ..... 100/29
4,912,908 A * 4/1990 Sakaki ..... 100/29
5,155,982 A * 10/1992 Boek et al. ..... 100/29
5,954,899 A * 9/1999 Figiel et al. ..... 100/33 PB

FOREIGN PATENT DOCUMENTS

EP 0022615 A1 1/1981
FR 2616124 A1 12/1988

* cited by examiner

*Primary Examiner*—Stephen F. Gerrity
(74) *Attorney, Agent, or Firm*—George Pappas

(57) ABSTRACT

A hoop-casing device comprising means for stretching a strip and for friction welding two overlapping ribbon parts between two welding cheeks (2,3). Each means is assigned a motor, a switch (4,5) for control by a control circuit, and a cam (6,7) to actuate said switch. Both cams (6,7) are pivotally mounted on a corresponding shaft part (10,32) around a common axis of rotation in an adjustable relative rotating position. One of the welding cheeks (2) can be orthogonally adjusted in relation to the axis of rotation (8) by means of a cam gear. The cam gear has a cam disk which can rotate along with one of the cams (6) around an axis (8) in addition to a telescopic tappet which is functionally arranged between the cam disk and the welding cheek (2). The telescopic tappet can be telescopically inserted and extended in an orthogonal position relative to the axis of rotation (8) and is spring loaded in relation to its extension. The rotational position of the cam disk relative to at least one of the cams (6) is rotationally limited with respect to the device when it rotates around the axis of rotation (8). Both shaft pieces (10,32) can be connected by means of mutual toothed wheel work.

21 Claims, 13 Drawing Sheets

HOOP-CASING DEVICE

This is the national phase under 35 USC §371 of PCT International Application No. PCT/CH98/0245 which has an international filing date of Jun. 18, 1998 and designating the United States of America.

TECHNICAL FIELD

This invention concerns a device for hooping an object by means of a heat-weldable plastic strip strapped around it.

BACKGROUND OF THE INVENTION

A hoop-casing device of the aforementioned type is known for instance from U.S. Pat. No. 3,269,300 and comprises a means for tensioning the strip and a means for friction-welding two mutually overlapping strip portions of the tensioned strip between two welding jaws. Each of these means is assigned a motor, a switch for controlling this motor via a control circuit, and a cam for actuating the switch. The two cams can be rotated jointly about a common rotation axis. One of the welding jaws can be displaced in a direction essentially orthogonal to the rotation axis while being adjustable by means of a cam gear. The cam gear comprises a cam disk that can be rotated about the rotation axis along with one of the cams, and a telescopic tappet that is functionally arranged between the cam disk and the displaceable welding jaw and is telescopically retractable or extensible in a direction essentially othogonal to the rotation axis and is spring-loaded loaded in its direction of extension.

A drawback of this known hoop-casting device is that the force that presses the welding jaws against the plastic strips depends on the latter's thickness. If the pressing force is too great the motors are demanded too much power output, the rotation speed of the motors drops, and the hoop-casing device no longer operates properly. Nevertheless, in this known hoop-casing device there is provided no adaptation capability that would allow to use plastic strips of various thickness values.

SUMMARY OF THE INVENTION

Accordingly, the object of the invention is to provide a hoop-casing device of the relevant generic type that does not have the aforementioned drawback and hence, that will allow for the use of plastic strips of various thickness values.

In this embodiment of the hoop-casing device according to the invention, the maximum force that urges the welding jaws towards each other is determined by the rotational position of the cam disk relative to at least one of the cams, all the more as this maximum force appears at an extremal rotational or angular position of the cam disk that results from at least one of the cams having a restricted rotation capability in the course of its rotation about the rotation axis relative to the device. The invention allows this maximum force to be adjusted by means of the adjustment of the rotational position of the cam disk relative to said cam and thus, to be selected depending on the thickness of the plastic strips, which allows to use the hoop-casing device with plastic strips of various thickness values. For example, plastic strips of 0.4 mm to 1.05 mm thickness can be used, with the force that presses the welding jaws onto the plastic strips being adjustable so as to keep almost the same value, so that the hoop-casing device always operates properly independent from the thickness of the plastic strips.

Advantageous embodiments of the hoop-casing device according to the invention are defined in the dependent claims.

More particularly, one of the cams can be assigned a stop projection to limit its rotation about the rotation axis in cooperation with a stop fixedly arranged at the device, which will determine the extremal rotational or angular position of the cam disk that, for its part, will determine the maximum force that urges the welding jaws towards each other.

The followings combination may be deemed especially advantageous: The cams each are arranged at a respective assigned shaft part. The rotation axis is shared between both shaft parts. The two shaft parts can be separated from each other between the two cams or connected to each other rigidly with regard to rotation in respect of each other by means of a mutually meshing gear. This gear is embodied as a longitudinal gear having generatrices oriented parallel to the rotation axis. In the vicinity of a respective end portion thereof, one of the two shaft parts is embodied as a trunnion and provided with an external toothing and the other one is embodied as a sleeve part provided with an internal toothing. In the vicinity of their respective trunnion-shaped or sleeve-shaped end portion, the two shaft parts can be coaxially inserted into, displaced relative to, and separated from, each other. The cam disk embodied as an eccentric cylinder is arranged at a shaft part that is rotatable relative to, and fixed in axial direction relative to, the device, whereas the other shaft part is arranged at the device so as to be rotatable as well as displaceable in axial direction. The shaft part that is displaceable in axial direction is supported by means of a spring element at a housing portion that is fixedly arranged at the device, arranged to protrude from the housing portion, and stressed by the spring element towards the shaft part that is fixed in axial direction. Thus, the shaft part that is displaceable in axial direction can be pulled out manually at the housing portion—with the help of a knob provided for this purpose—and then angularly displaced, upon its release the pulled-out shaft part will tend to mesh again with the other shaft part: the relative rotational position of the shaft parts thus arrived at will determine the relative rotational position of the stop projection and the cam disk and hence, the extremal rotational or angular position of the cam disk and the maximum force that urges the welding jaws towards each other, in this manner this urging force can be adjusted to fit the thickness of the plastic strips.

In combination With the preceding, there may also be deemed especially advantageous: The one longitudinal toothing is provided with a bridgework region in which a plurality of teeth appear to be fused together from tip to tip when viewed in cross-section, this one longitudinal toothing thus being provided with a filling. The other longitudinal toothing is provided with a teeth gap region in which a plurality of teeth have been omitted from root to root when viewed in cross-sectional, this other longitudinal toothing thus being provided with a recess. The bridgework region extends across a smaller number of teeth and thus, with respect to the rotation axis, across a circular arc of smaller extent than the teeth gap region. In this manner the two shaft parts may only be connected i.e. mesh one into the other over a predetermined sensible region, whereas unreasonable and hazardous operating conditions are avoided.

BRIEF DESCRIPTION OF THE DRAWING

An exemplary embodiment of the invention is explained below with reference to the drawing.

In all Figures, parts corresponding to each other are designated with the same reference numerals.

DETAILED DESCRIPTION OF THE PREFERRED EMBODIMENTS

A hoop-casing device of the relevant generic type serves to hoop an object with a heat-weldable plastic strip placed around it, with a loop being made around the object from this strip and then tensioned. Once the strip has reached an appropriate tension it is sealed to form a hoop by heat-welding overlapping ends thereof.

The hoop-casing device according to the invention will be described below with reference to an exemplary embodiment that is deemed particularly advantageous, it being understood that the invention must not be limited to this exemplary embodiment.

The hoop-casing device is provided with a unit, driven by a tensioning motor, for tensioning the plastic strip. Such a unit is well known per se, for instance from the aforementioned document U.S. Pat. No. 3,269,300, and will not be described here in detail because it is the control of the motor of this unit that matters in the embodiment of the hoop-casing device described here.

Figure 2:
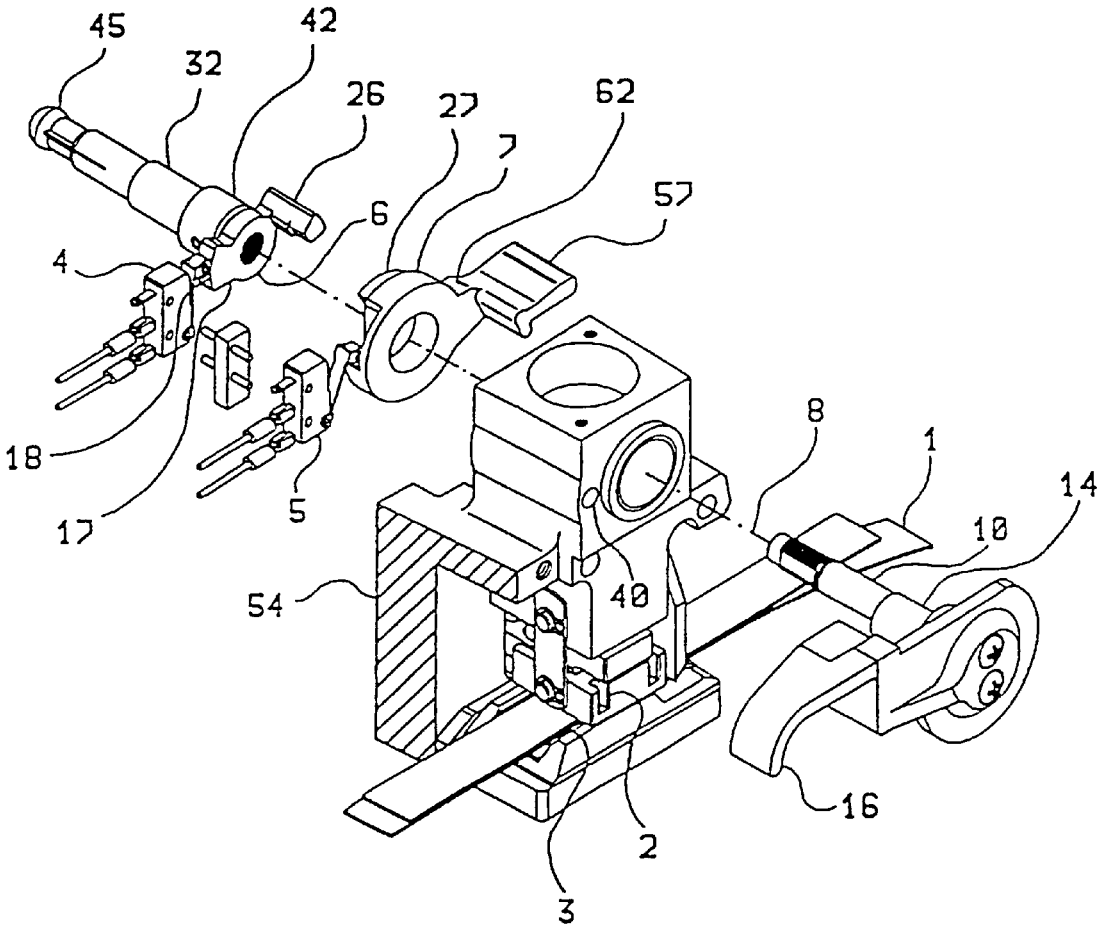
FIG. 2 shows a further perspective explosion view of the parts of the hoop-casing device according to FIG. 1, represented in another viewing direction.
Figure 13:
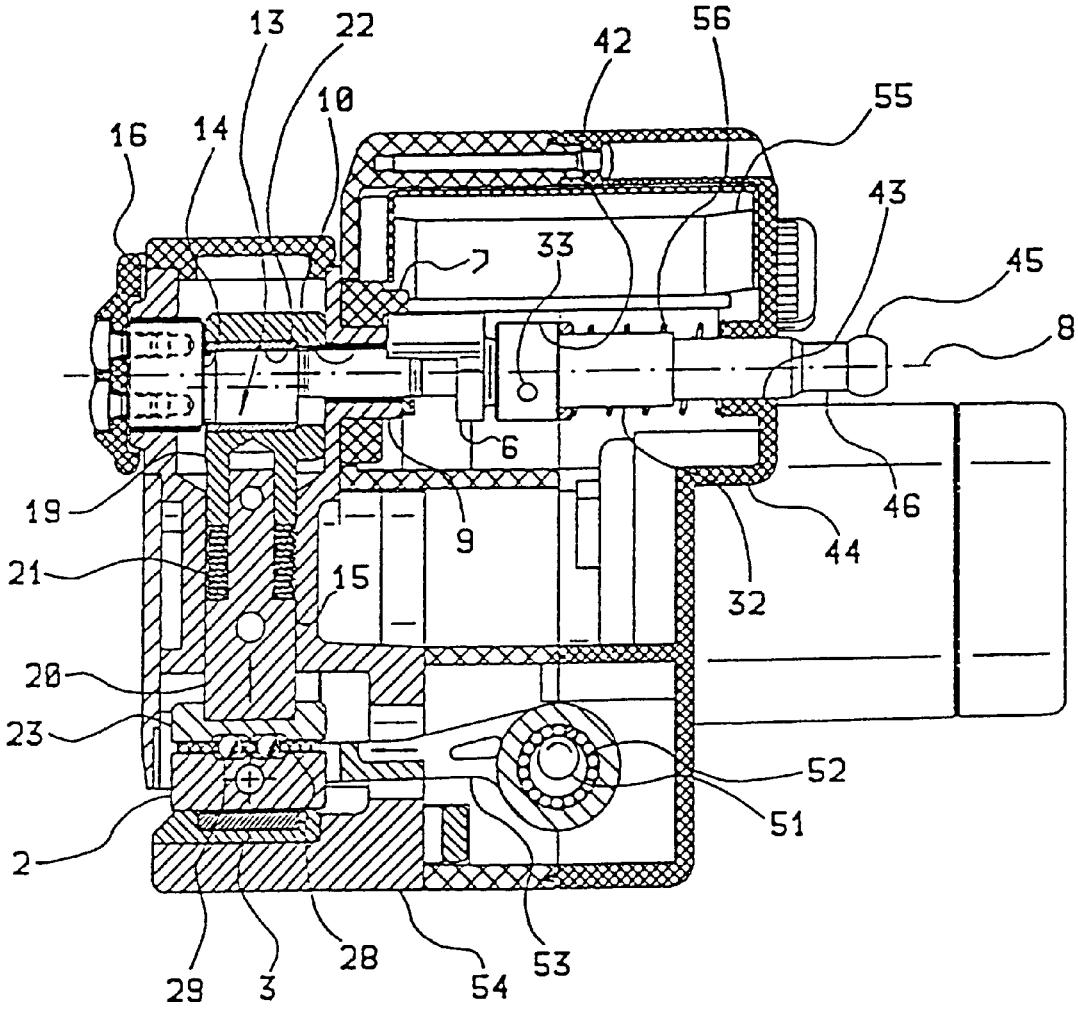
FIG. 13 shows a side view of the shafts according to the invention of a hoop-casing device in the same end position of the shafts as in FIGS. 1, 2 and 3, as well as a sectional view of housing portions of the hoop-casing device passing through a rotation axis of the shafts and a direction of displacement of welding jaws of the hoop-casing device.

Furthermore the hoop-casing device is provided with a unit for friction-welding two mutually overlapping strip portions of the tensioned strip between two welding jaws driven by a friction-welding motor. The principle of such a unit is known per se, for instance from the aforementioned document U.S. Pat. No. 3,269,300. In FIG. 2 there are shown the tensioned plastic strip 1 and the welding jaws 2 and 3 that grip it (FIGS. 2, 6, 9, 13). In FIG. 13 the shaft 51 of the friction-welding motor is visible in a sectional view, which shaft reciprocates the welding jaw 2 during the friction-welding operation via an eccentric bearing 52 and a connecting rod 53 relative to the other welding jaw 3 that is fixedly arranged at a housing portion 54 of the hoop-casing device.

The two aforementioned motors are controlled by a switch assigned thereto via an control circuit assigned thereto. Such motors can be embodied as electric motors, but also as pneumatic motors, and can be assigned an electric, electro-pneumatic or pneumatic control ciruit, as may be the case. In the present description there is given an exemplary embodiment of the hoop-casing device equipped with electric motors.

Figure 4:
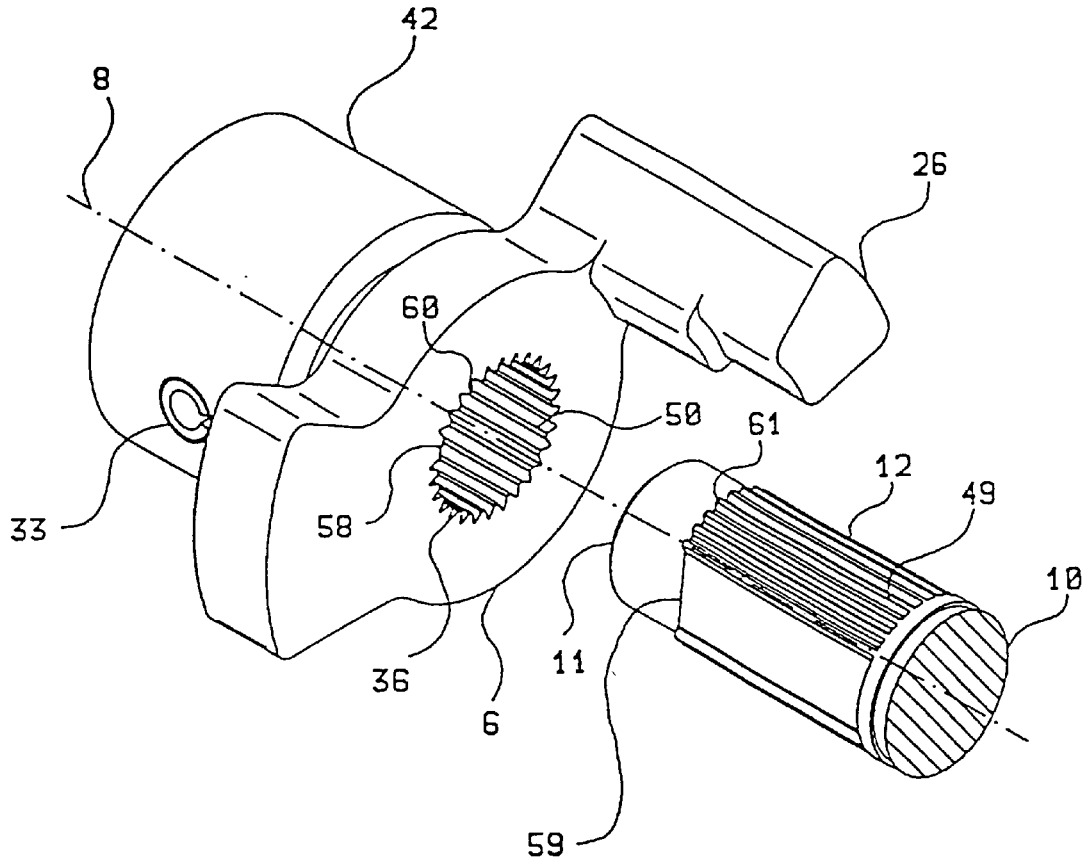
FIG. 4 shows a perspective explosion view of two particular parts of the hoop-casing device according to FIG. 1 in order to illustrate a mutual longitudinal toothing of these parts.
Figure 11:
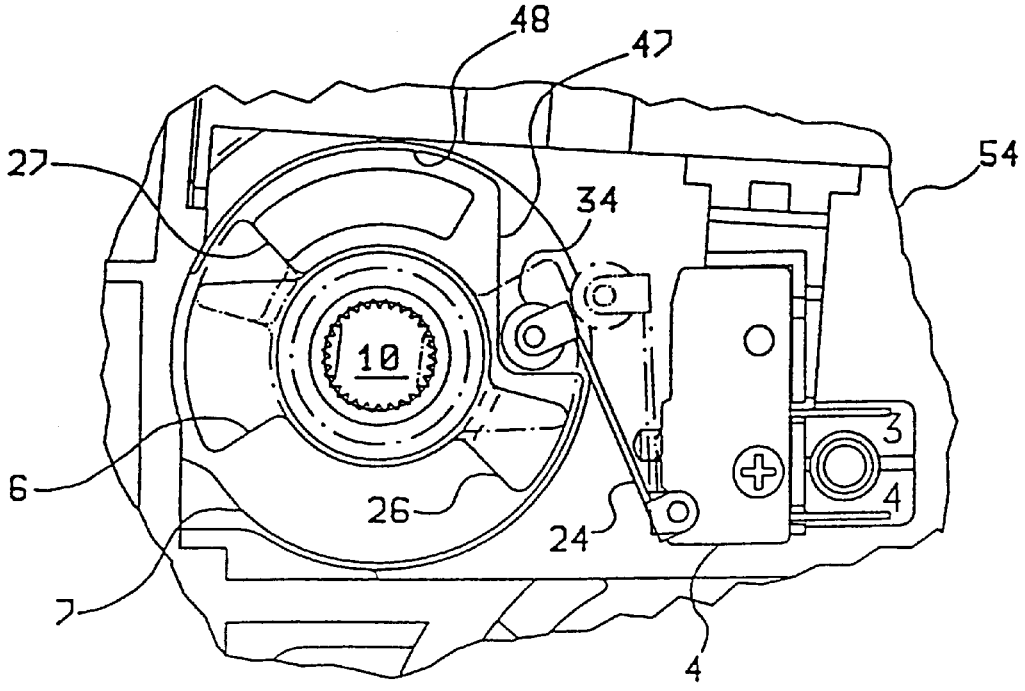
FIG. 11 shows a side view of parts of a hoop-casing device in the same initial position as in FIGS. 5, 6 and 7 in order to particularly illustrate the cams and switches and their cooperation.
Figure 12:
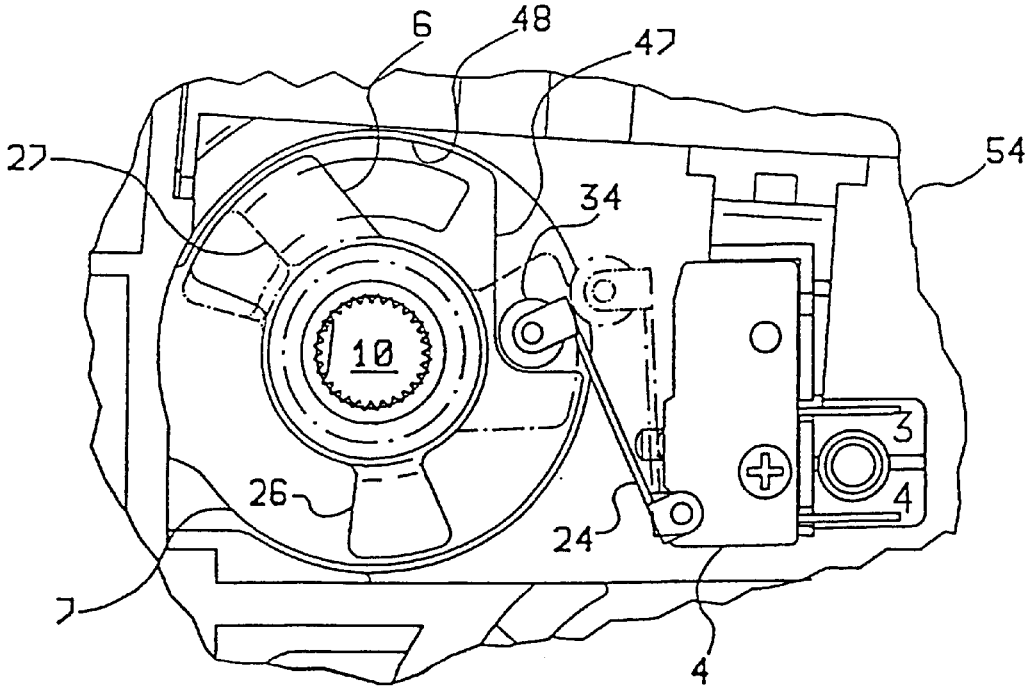
FIG. 12 shows a side view of parts of a hoop-casing device in the same initial position as in FIGS. 8, 9 and 10 in order to particularly illustrate the cams and switches and switches and their cooperation.

A control block 55 (FIG. 13) is arranged at a housing portion 54 of the hoop-casing device and accommodates the two switches and electronic control circuits for the motors (in FIGS. 4 and 13 the two switches 4 and 5 are not visible, in FIGS. 11 and 12 the two switches are positioned exactly one behind the other, the switch 4 conceals the switch 5).

The switches 4 and 5 each are provided with a switch lever 24 and 25, respectively, that, for its part, is provided with a pickup roller 34 or 35, respectively (indicated in FIGS. 6, 7, 11, 12) by means of which the switches 4 and 5 each are controlled by a respective cam 6 or 7 assigned thereto. The two cams 6 and 7 can rotate independent from each other about a common rotation axis 8, and they can cooperate by having a stop projection 26 of the cam 6 (indicated in FIGS. 1, 2, 3, 4, 11, 12, 14) meeting a stop 27 (indicated in FIGS. 1, 2, 3, 7, 11, 12, 14).

Figure 5:
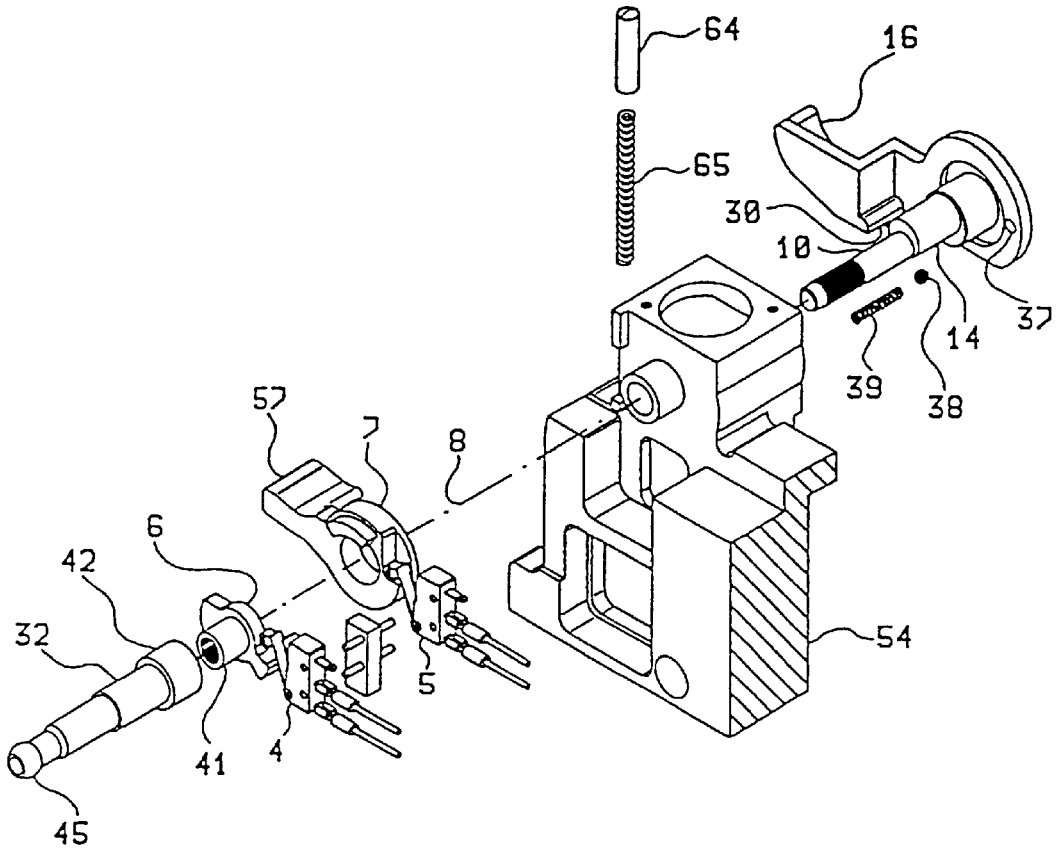
FIG. 5 shows a perspective explosion view of parts of a hoop-casing device in order to illustrate the hoop-casing device according to the invention in a particular initial position thereof.
Figure 8:
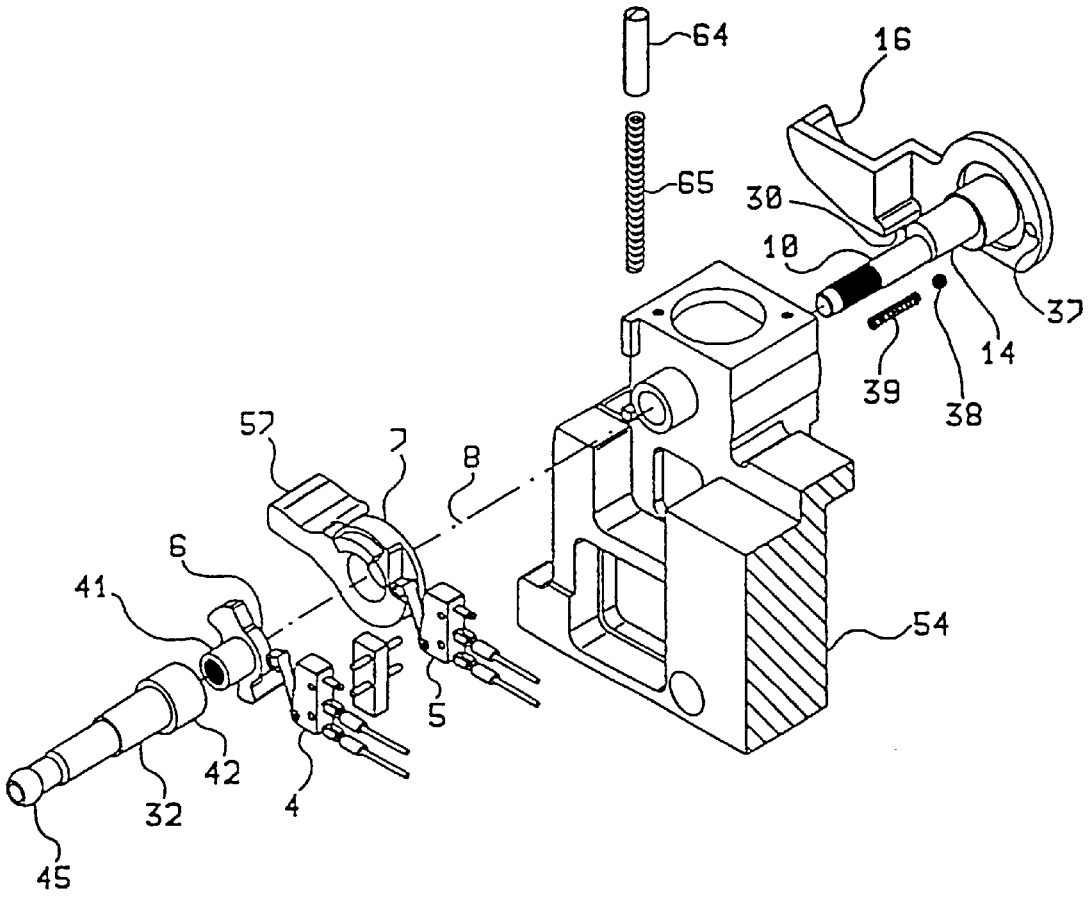
FIG. 8 shows a perspective explosion view of parts of a hoop-casing device as in FIG. 5, however, with the hoop-casing device according to the invention in another initial position.
Figure 9:
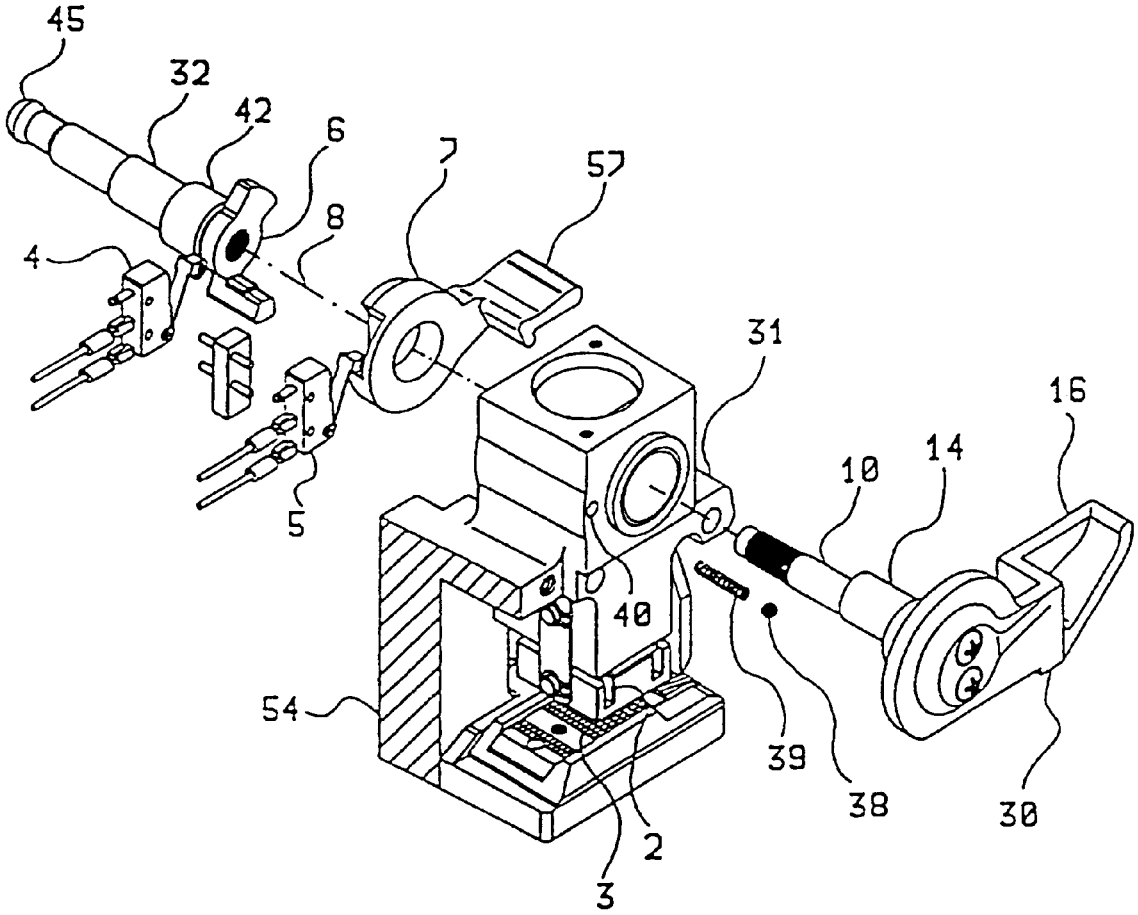
FIG. 9 shows a further perspective explosion view of the parts of the hoop-casing device according to FIG. 8, represented in another viewing direction.
Figure 10:
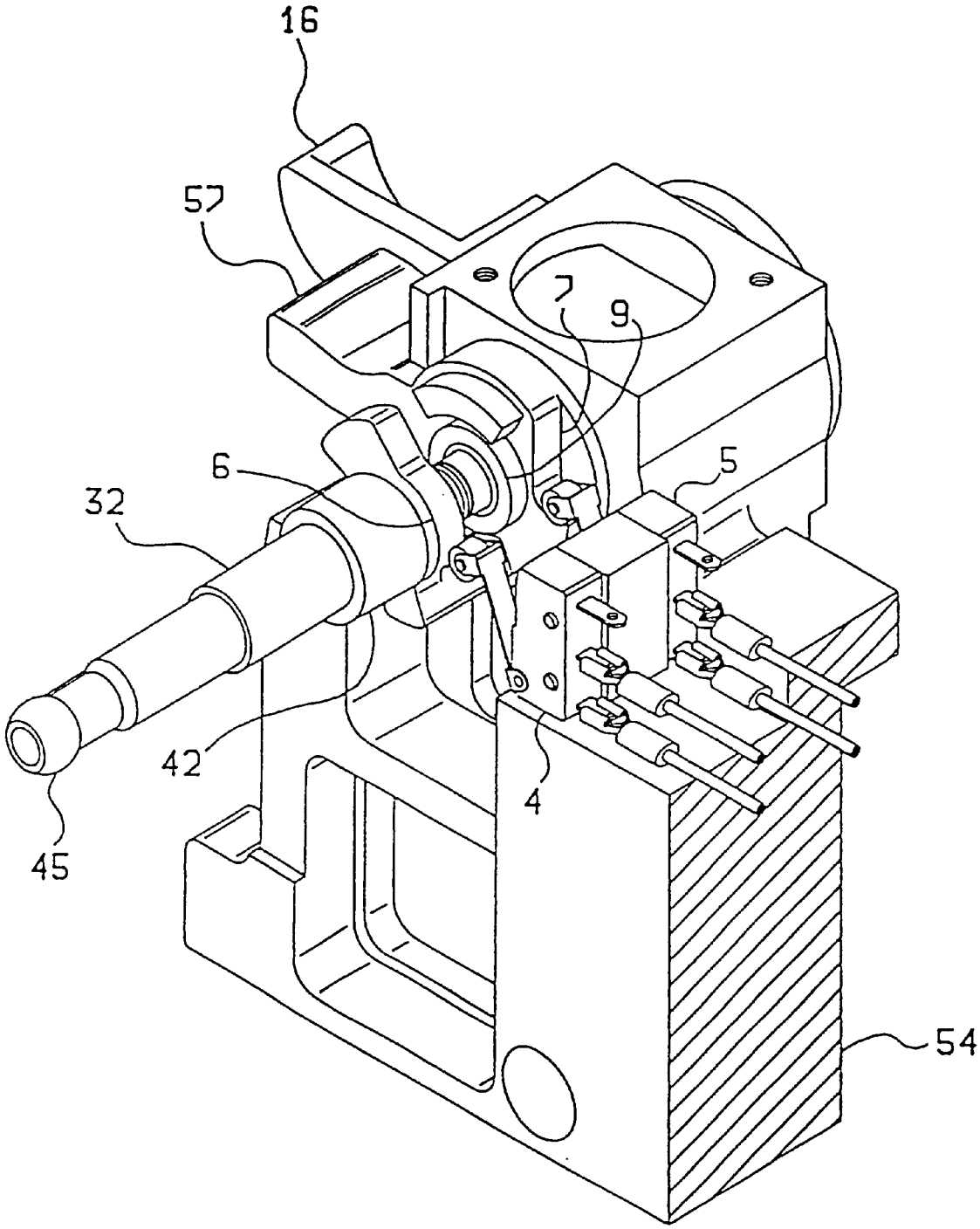
FIG. 10 shows a perspective view of the parts of the hoop-casing device according to FIG. 8 mounted at each other.

The tensioning motor is controlled by the cam 7 that is mounted at a sleeve part 9 (FIGS. 1, 3, 10, 13) of the housing portion 54 and can rotate about the rotation axis 8. The cam 7 is provided with an actuation lever 57 whose root portion 62 (FIG. 2) acting as a stop projection can meet a stop 63 (FIG. 1) of the housing portion 54, which will limit the rotation of the cam 7. Moreover, the actuation lever 57 is stressed towards the stop 63 by a spring 65 (FIGS. 1, 5, 8) that passes through a guide tube 64. Thus, when its root portion 62 meets the stop 63 the cam 7 is in a rest position.

When an operator pushes the cam 7 away from its rest position by means of the actuation lever 57, the cam 7 is rotated in such manner that the pickup roller 35 of the switch 5 assigned thereto emerges from a recess 47 (FIGS. 6, 11, 12) of the cam 7 and comes to rest on a periphery 48 (FIGS. 6, 11, 12) of the cam 7, which actuates the switch 5 by means of its lever 25. This puts the tensioning motor into operation until its electronic control circuit located in the control block 55 will detect a predetermined overcurrent and switch off the tensioning motor, for such an overcurrent signals that a desired predetermined tension of the plastic strip 1 has been reached. Of course, the tensioning motor will also be switched off when the operator releases the actuation lever 57 to allow it to return to its rest position by the action of the spring 65.

In order to achieve the aforementioned cooperation of the cam 6—that controls the friction-welding subsequent to the tensioning—with the cam 7, a control shaft 10 is supported at the housing portion 54, coaxial to the sleeve part 9, and can rotate about the rotation axis 8, An actuation lever 16 is provided at the one end of the control shaft 10. In the vicinity of the other, trunnion-shaped, end portion 11 of the control shaft 10 the latter is provided with a toothing 12 that fits releasably to a toothing 36 (FIGS. 1, 4, 6) of the cam 6, which allows the cam 6 to be mounted at the trunnion-shaped end portion 11 of the control shaft 10, rigidly with regard to rotation in respect of each other (FIGS. 3, 7, 10, 13, 14), or to be removed therefrom. When the cam 6 is mounted at the control shaft 10 the operator can adjust and modify the rotational position of the cam 6 by means of the actuation lever 16 and by doing this, start the friction-welding operation as will be described below.

Figure 1:
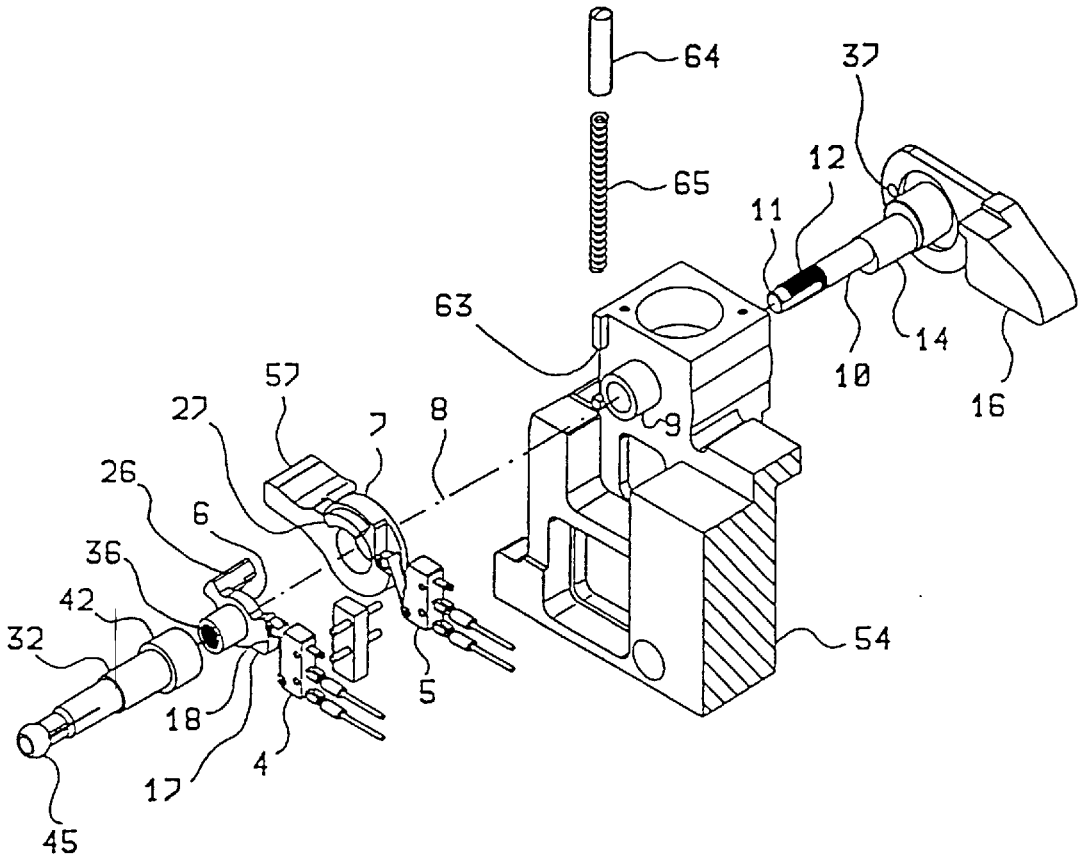
FIG. 1 shows a perspective explosion view of parts of the hoop-casing device in order to illustrate the hoop-casing device according to the invention in an end position thereof.
Figure 3:
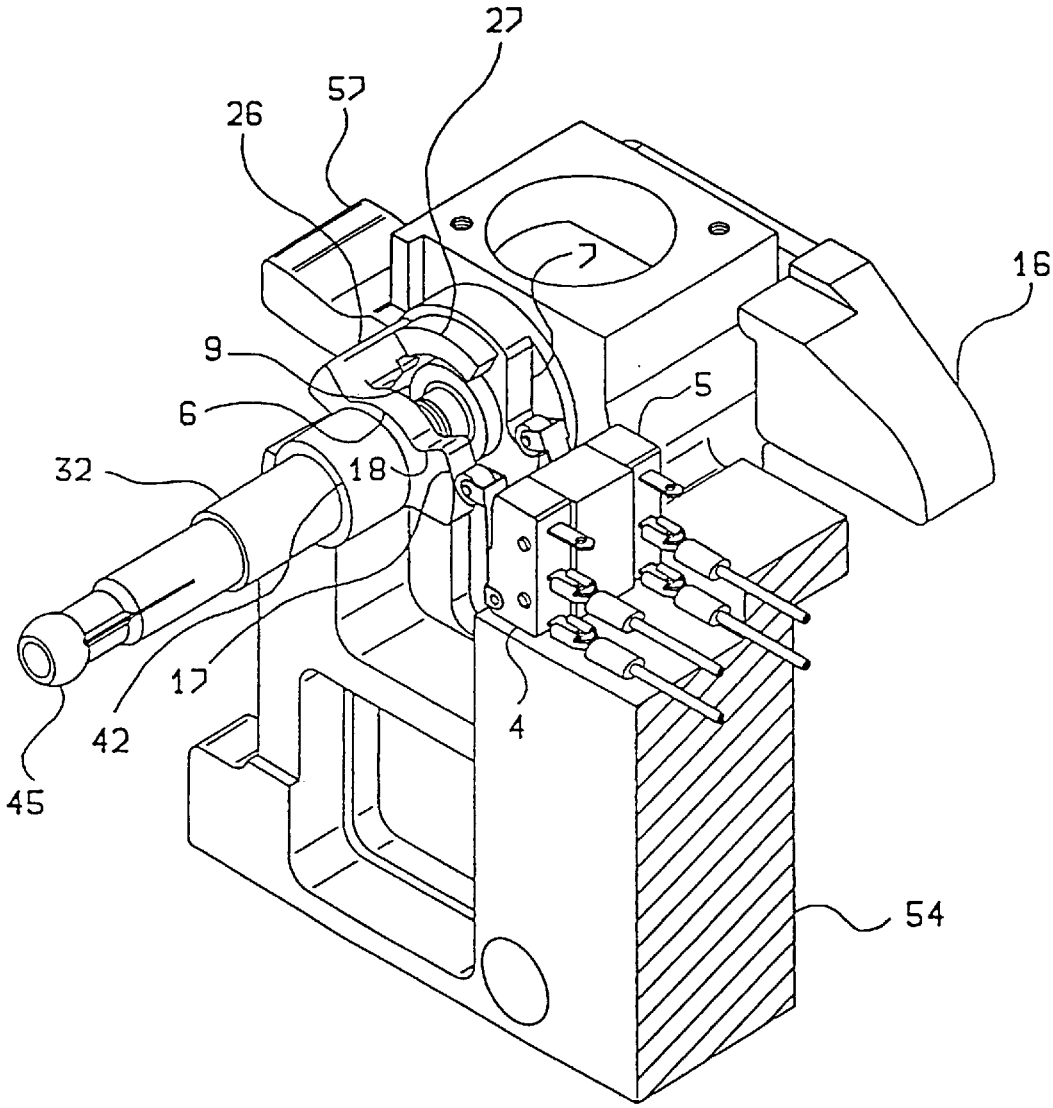
FIG. 3 shows a perspective view of the parts of the hoop-casing device according to FIG. 1 mounted at each other.
Figure 14:
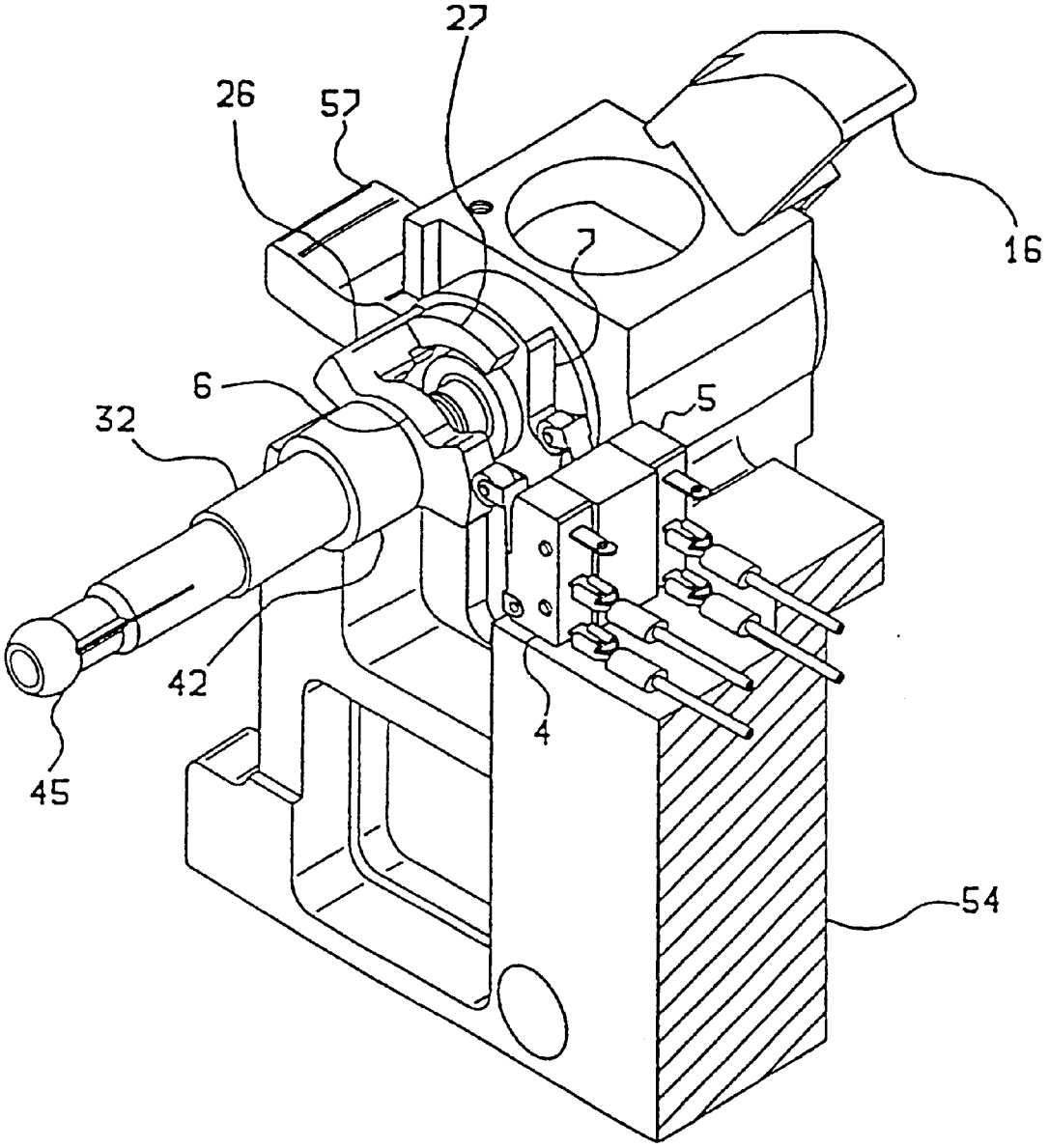
FIG. 14 shows a perspective view of the parts of the hoop-casing device according to FIG. 1 mounted at each other, however, with the hoop-casing device according to the invention in another end position.

Accordingly, in the normal course of operation of the hoop-casing device the above-described position of the cams 6 and 7 is an end position (FIG. 3 in a perspective view, FIGS. 1 and 2 in an explosive view). In this connection, the corresponding end position of the control shaft 10 having arranged at it the actuation lever 16 depends on the relative rotational position in which the cam 6 is mounted at the control shaft 10. The use of a different relative rotational positionwhen the cam 6 is being mounted at the control shaft 10 will result in an different end position of the control shaft 10 and the actuation lever 16 (FIG. 14).

In the manner that will be described below, the thus attained end position of the control shaft 10 i.e. its extremal rotational or angular position determines the force with which the welding jaws are urged towards each other.

The welding jaw 2 (i.e. that one of the two welding jaws 2 and 3 which is located next to the control shaft 10) can be displaced relative to the housing portion 54 in a direction essentially orthogonal to the rotation axis 8 (FIG. 13). The distance of the welding jaw 2 to the rotation axis 8 is determined by the position of the other welding jaw 3 and the thickness of the plastic strip 1 located inbetween. The force with which the welding jaws 2 and 3 are urged towards each other and compress the plastic strip 1 can be adjusted by means of a cam gear 13. This cam gear 13 comprises, in the role of the cam disk 14, an eccentric cylinder (more clearly visible in FIGS. 1, 2, 5, 6, 8, 9) formed at the control shaft 10 and a telescopic tappet 15 that is functionally arranged between the cam disk 14 and the displaceable welding jaw 2 and directed essentially orthogonal to the rotation axis 8. The retractable and extensible telescopic tappet 15 comprises two tappet parts 19 and 20 that can be telescopically displaced with respect to each other, and between them a compression spring element 21 that stresses the telescopic tappet 15 in a direction of extension thereof. Between the cam disk 14 and the tappet part 19 there is also arranged a sliding sleeve 22. Moreover, between the welding jaw 2 and the tappet part 20 there are arranged, adjacent to each other, a thrust part 23 and a ball or roller bearing 28, whereby the force exerted by the compression springer 21 in a direction orthogonal to the rotation axis 8 is transferred by the tappet part 20 onto the thrust part 23, and whereby balls or rollers of the bearing 28 pass this force further onto the welding jaw 2.

In one or the other of the aforementioned end positions of the control shaft 10 ( FIG. 3 or 14, respectively), the welding jaws 2 and 3 are urged onto each other and to compress the plastic strip 1 located inbetween, as may be the case. In this connection, the force with which the welding jaws 2 and 3 are urged towards each other and compress the plastic strip 1 is determined by the effective length of the telescopic tappet 15, i.e. by the relative position of the tappet parts 19 and 20, which position, for its part, depends on the rotational position of the cam disk 14 and consequently, on the rotational position of the control shaft 10 in the respective end positions.

A rotation of the control shaft 10 away from its end position first relieves the welding jaws 2 and 3 from being urged towards each other and eventually (in the course of further rotation) lifts off the weldings jaws 2 and 3 from each other. Corresponding to this function and in support thereof. the parts of the cam gear 13 are arranged (in a manner not shown) fixedly adjacent to each other in a direction essentially orthogonal to the rotation axis 8, and the extension of the telescopic tappet 15 is limited (in a manner not shown) by a system of transversal pin and longitudinal slot, which allows the telescopic tappet 15 to lift off and pull away the welding jaw 2 from welding jaw at a corresponding rotational position of the control shaft 10.

The aforementioned rotation of the control shaft 10 away from its end position results from the operator's action by means of the actuation lever 16. In this connection, the control shaft 10 can be rotated up to a starting position (FIGS. 5, 6, 7, 8, 9, 10) in which a stop projection 30 (FIGS. 5, 6, 8, 9) of the actuation lever 16 meets a stop 31 (FIGS. 6, 9) of the housing portion 54. In this starting position the welding jaws 2 and 3 are completely lifted off from each other. A catch holds the actuation lever 16 in this starting position by providing resistance against unintentional rotational displacement: this catch is made up of a recess 37 of hollow-spherical shape provided in the actuation lever 16 (FIGS. 1, 5, 8) in cooperation with a ball 38 (FIGS. 5, 6, 8, 9) that is stressed towards the recess 37 by a spring 39, the spring 39 and at least part of the ball 38 being arranged in an accommodating bore hole 40 (FIGS. 2, 6, 9) of the housing portion 54.

In the aforementioned end positions of the control shaft 10 (FIG. 3 or 14, respectively), the stop projection 26 of the cam 6 cooperates with the stop 27 of the cam 7. A rotational displacement of the actuation lever 57 brought about by the operator's thumb causes, by means of the stop 27 of the cam 7 and the stop projection 26 of the cam 6, a rotation of the control shaft 10 away from its corresponding end position, which will relieve the welding jaws 2 and 3 from being urged towards each other and manifest itself in the rotational movement of the actuation lever 16. In this manner it is ensured that no tensioning of the plastic strip 1 will be triggered unnoticed and unintentionally as long as the welding jaws 2 and 3 fail to be completely lifted off from each other.

In contrast, when the actuation lever 16 is in its starting position ( FIGS. 5, 10) and the operator turns it from its starting position up to one of its end positions (FIG. 3 or 14, respectively) this causes the pickup roller 34 of the switch lever 24 of the switch 4 to be lifted radially onto a periphery 18 of a sector lobe 17 of the cam 6 (FIGS. 1, 2), which actuates the switch 4 by means of its switch lever 24. This puts the friction-welding motor into operation until its electronic control circuit located in the control block 55 will switch it off when a desired predetermined operation time has elapsed, which time corresponds to an optimal welding duration.

As already set forth, the force with which the welding jaws 2 and 3 are urged towards each other and compress the plastic strip 1 during the welding process is determined by the rotational position of the control shaft 10 in the respective end positions (FIG. 3 or 14, respectively). Due to the simultaneous cooperation of, on the one hand, the stop projection 26 of the cam 6 with the stop 27 of the cam 7, on the other hand, the root portion 62 of the actuation lever 57 of the cam 7 with the stop 63 of the housing portion 54, these end positions, for their part, depend on the rotational position of the cam 6 on the control shaft 10. Thus, for the purpose of adjusting the force, the relative rotational position of the cam disk 14 and the cam 6 can be adjusted by means of the relative rotational position in which the cam 6 is mounted at the control shaft 10, as described in the following.

Figure 6:
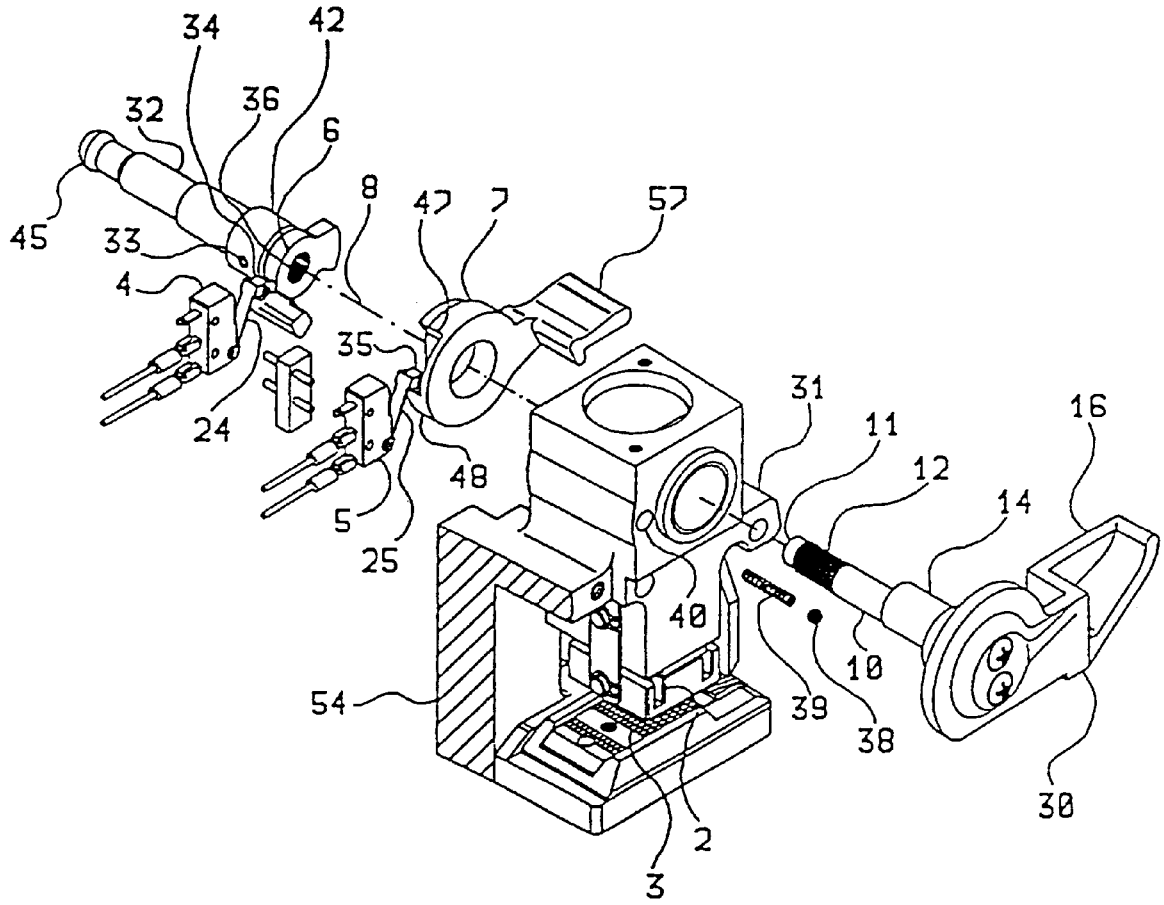
FIG. 6 shows a further perspective explosion view of the parts of the hoop-casing device according to FIG. 5, represented in another viewing direction.
Figure 7:
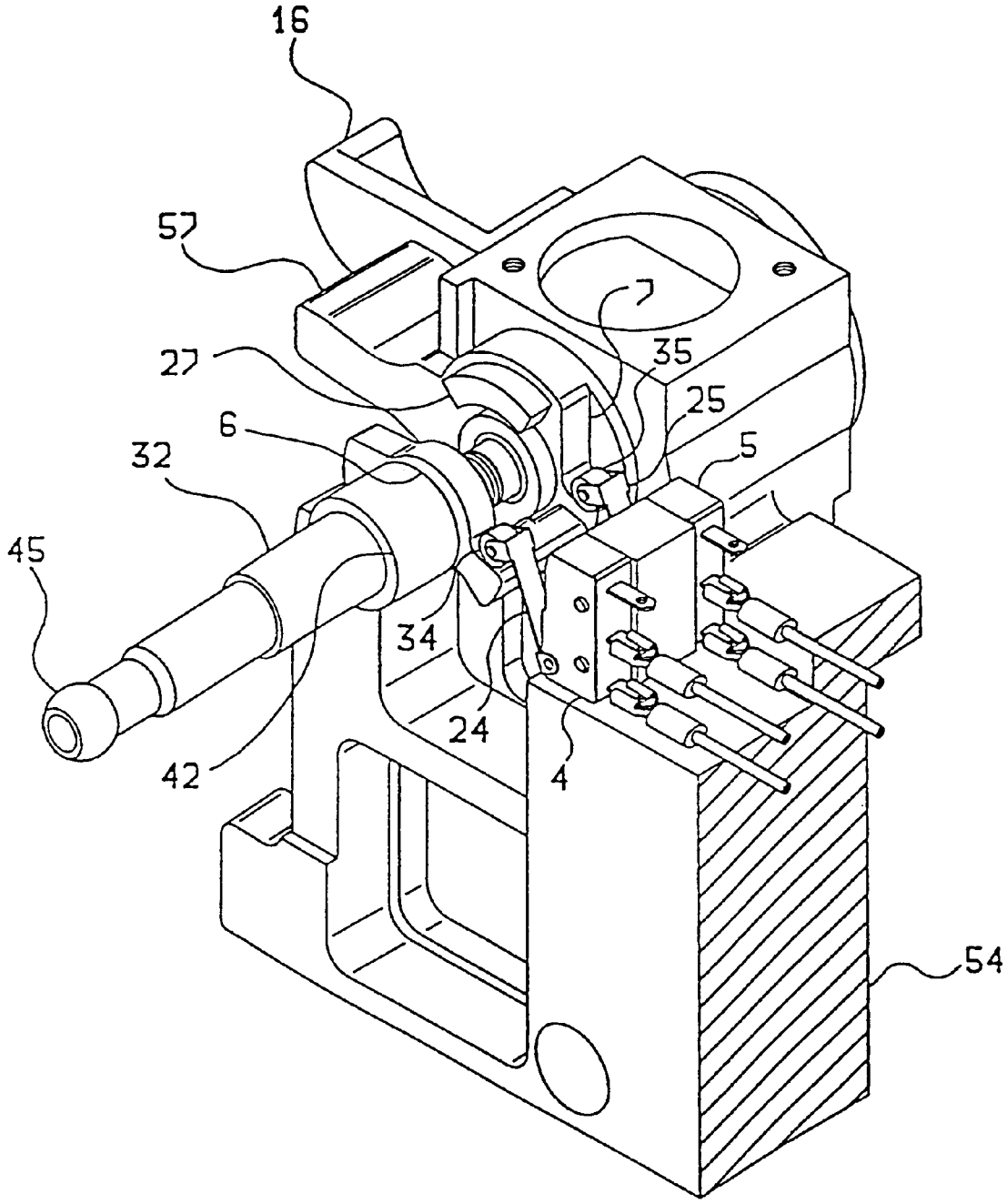
FIG. 7 shows a perspective view of the parts of the hoop-casing device according to FIG. 5 mounted at each other.

Tile cam 6 is provided with a sleeve part 41 (FIGS. 5, 8) that is constructed on the inside to be provided with the toothing 36 and on the outside to be cylindrical. By means of its cylindrical outside sleeve part 41 is arranged at the end of an auxiliary shaft 32 in a cylindrical accommodating sleeve 42 and attached thereto by means of an adapter sleeve 33 (FIGS. 4, 6). When the cam 6 with its toothing 36 is mounted at the toothing 12 of the control shaft 10 and hence, at the end 11 of the control shaft 10, rigidly with regard to rotation in respect of each other (FIGS. 3, 7, 10, 13, 14), the auxiliary shaft 32 is positioned coaxial to the control shaft 10 in the continuation thereof along the rotation axis 8. In this connection, the auxiliary shaft 32 is supported in axially displaceable manner in a bearing 43 (FIG. 13) of a further housing portion 44 fixedly arranged at the housings portion 54. An end portion 46 of the auxiliary shaft 32 protrudes from the housing portion 44 and is provided with a knob 45 at its free end.

A spring 56 (FIG. 13) is arranged on the auxiliary shaft 32 between the accommodating sleeve 42 and the housing portion 44 and stresses the accommodating sleeve 42 towards the control shaft 10. Manually and with the help of a knob 45 provided at the free end of the auxiliary shaft 32, the auxiliary shaft 32 can be pulled axially, away from the control shaft 10, against the force of this spring 56, which releases the mutual meshing of the toothing items 12 and 36 and at the same time pulls away and removes the cam 6 from the control shaft 10. When the knob 45 is released the toothing items 12 and 36 again meet with each other and mesh as corresponds to the relative rotational position of the cam 6 and the end 11 of the control shaft 10 i.e. also as corresponds to the relative rotational position of the auxiliary shaft 32 and the control shaft 10. In order to facilitate the re-mounting of the sleeve part 41 of the cam 6 at the end 11 of the control shaft 10 it is provided that the toothing 12 stops just short of the end 11 of the control shaft 10 and this end 11, for its part, is embodied as a trunnion of smaller diameter.

To summarize thus, the two cams 6 and 7 each are arranged at a respective assigned shaft part, namely the control shaft 10 and the auxiliary shaft 32, respectively; these two shaft parts each are provided with a common rotation axis 8 and can be separated from each other or connected to each other rigidly with regard to rotation in respect of each other between the two cams 6 and 7 by means of a mutual meshing of toothing items. The one shaft part, namely the control shaft 10, is arranged at the device so as to be rotatable and fixed in axial direction, and supports the cam disk 14. The other shaft part 32 is arranged at the device so as to be rotatable and diplaceable in axial direction, the axially displaceable shaft part 32 is supported by means of a spring element 56 at a housing portion 44 that is fixedly arranged at the housing portion 54, it is arranged protruding from the housing portion 44, and it is stressed by the spring element 56 towards the shaft part 10 that is fixed in axial direction.

In the illustrated exemplary embodiment the toothing items 12 and 36, respectively, are embodied as longitudinal toothing items having respective generatrices 49 and 50 oriented parallel to the rotation axis 8 (FIG. 4). On the control shaft 10 the longitudinal toothing 12 is an external toothing located in the vicinity of the trunnion-shaped end portion 11 of the control shaft 10. On the auxiliary shaft 32 the longitudinal toothing 36 is an internal toothing located within the sleeve part 41 of the cam 6 that, for its part, is located within the accommodating sleeve 42 at the end of the auxiliary shaft 32, so that the longitudinal toothing 36 is arranged in the vicinity of an end portion of the auxiliary shaft 32. Owing to their form and construction the two longitudinal toothing items 12 and 36 can be coaxially inserted into, displaced relative to and separated from each other. Therefore, the same applies to the two shaft parts 10 and 32 in the range of their respective end portions, namely the trunnion-shaped end portion 11 of the control shaft 10 and the sleeve-shaped end portion 42 of the auxiliary shaft 32.

To ensure that unreasonable and/or hazardous operating conditions—that could appear when the sleeve part 41 of the cam 6 is re-mounted in any random position at the end 11 of the control shaft 10 after having been pulled away and angularly displaced—are precluded from occurring, the mounting of the shaft parts 10 and 32 onto each other in unacceptable relative rotational positions is prevented as described in the following.

The longitudinal toothing 36 of the auxiliary shaft 32 is provided with a bridgework region 58 in which a plurality of teeth 60 of the longitudinal toothing 36 appear to be fused together from tip to tip when viewed in cross-section, this longitudinal toothing 36 thus being, in said region, so to speak provided with a filling. The longitudinal toothing 12 of the control shaft 10 is provided with a teeth gap region 59 in which a plurality of teeth 61 of the longitudinal toothing 12 have been omitted from root to root when viewed in cross-section, this longitudinal toothing thus being provided, in said region, with a recess. Therefore, the two longitudinal toothing items 12 and 36 only fit each other in such relative rotational positions in which the bridgework region 58 or filling can be introduced into the teeth gap region 59 or recess. An acceptable range of relative rotational positions of the shaft parts 10 and 32 is created by the fact that the bridgework region 58 extends across a smaller number of teeth i.e. with respect to the rotation axis 8, across a circular arc of smaller extent than the teeth gap region 59, so that the bridgework region 58 can be introduced into the teeth gap region 59 in a predetermined plurality of acceptable rotational positions. In this connection it must be understood that it will lead to the same result to interchange the longitudinal toothing items 12 and 36 in respect of their construction as a bridgework or teeth gap region. respectively, i.e. the teeth gap region 59 could be constructed at the shaft part 32 and the bridgework region 58 at the shaft part 10.

In the illustrated exemplary embodiment (FIG. 4), had the longitudinal toothing items of the shaft parts 10 and 32 not been provided with a respective bridgework or teeth gap region, then each of them would have 28 teeth each extending over a circular arc of about 13 angular degrees. The bridgework region 58 at the shaft part 32 comprises two teeth (about 26 angular degrees) and the teeth gap region 59 at the shaft part 10 comprises six teeth (about 78 angular degrees). This results in five possible rotational positions in which the two longitudinal toothing items 12 and 36 fit each other and make it possible to introduce the bridgework region 58 into the teeth gap region 59, or the filling into the recess, respectively. Therefore, the relative rotational position of the shaft parts 10 and 32 and hence, of the cam disk 14 to the cam 6, can be adjusted over a circular arc of about 64 angular degrees, or about 18% of one fill revolution.

In this connection, it must be understood that the number of teeth and the corresponding values of circular arcs that can be perceived in the illustrated exemplary embodiment (FIG. 4) are only given here for the purpose of illustration and may be selected different, as desired.

In the illustrated exemplary embodiment (FIG. 13) the cam disk 14 is formed at the control shaft 10 as an eccentric cylinder offset by about 40% of its radius.

The end position of the actuation lever 16 shown in FIG. 3 corresponds to a rotational position of the control shaft 10 in which the cam gear 13 is positioned fully outwards and the cam disk 14 applies the strongest spring-load to the telescopic tappet 15 in the latter's direction of extension. The whole arrangement is dimensioned in such manner that this rotational position provides for proper operating conditions when the thinnest plastic strips available in the provided assortment are being used, for instance with a thickness of 0.4mm.

In contrast, the end position of the actuation lever 16 shown in FIG. 14 corresponds to a rotational position of the control shaft 10 in which the cam gear 13 is positioned about 64 angular degrees, or about 18% of one full revolution, in advance of the rotational position shown in FIG. 3. In the illustrated exemplary embodiment (FIG. 13) this rotational position results in the cam disk 14 being retracted by about 25% of its radius and the telescopic tappet 15 being correspondingly less spring-loaded in its direction of extension. The whole arrangement is dimensioned in such manner that this rotational position provides for proper operating conditions when the thickest plastic strips available in the provided assortment are being used, for instance with a thickness of 1.05 mm.

Here, too, it must be understood that the dimensions that can be perceived in the illustrated exemplary embodiment (FIG. 13 ) only serve the purpose of illustration and may be selected different, as desired.

What is claimed is:

1. A device for hoop-casing an object by means of a thermo-weldable plastic strip (1) strapped around it, in which the device is provided with a means for tensioning the plastic strip (1) and a means for friction-welding two mutually overlapping strip portions of the tensioned plastic strip (1) between two welding jaws (2, 3), each of these means can be driven by a motor, each of these motors can be controlled by a switch (4, 5) via a control circuit, each of these switches (4, 5) can be actuated by a cam (6, 7), the cams (6, 7) can be rotated about a common rotation axis (8), while one of the cams (6) can be driven by means of a control shaft (10), at least one of the welding jaws (2) can be displaced in a direction orthogonal to the rotation axis (8) while being adjustable by means of a cam gear (13), and the cam gear (13) comprises a cam disk (14) that can be rotated about the rotation axis (8) along with the cam (6) that can be driven by means of the control shaft (10), and a telescopic tappet (15) that is arranged between the cam disk (14) and the displaceable welding jaw (2) and is telescopically retractable or extensible in a direction orthogonal to the rotation axis (8) and is spring-loaded in a direction of extension thereof, characterized in that:

a rotational position of the cam disk (14) is adjustable relative to the cam (6) that can be driven by means of the control shaft (10), when performing jointly a rotation about the rotation axis (8), the cam disk (14) and the cam (6) driven by means of the control shaft (10) and adjusted with respect to the cam disk (14) can be rotated in restricted manner with respect to the device between end positions, and the other cam (7) can be rotated in restricted manner between end positions.

2. The device according to claim 1, characterized in that the cam (6) that can be driven by means of the control shaft (10) can be rotated with an auxiliary shaft (32) about the rotation axis (8), the other cam (7) is arranged at a stationary sleeve part (9) and can also be rotated about the rotation axis (8), and the control shaft (10) and the auxiliary shaft (32) can be separated from each other between the two cams (6, 7) or connected to each other rigidly with regard to rotation in respect of each other.

3. The device according to claim 2, characterized in that the control shaft (10) and the auxiliary shaft (32) can be connected to each other by a mutually meshing gear (12, 36).

4. The device according to claim 3, characterized in that the gear (12, 36) includes, in a direction coaxial to the rotation axis (8), a longitudinal gear comprising an external toothing (12) and an internal toothing (36) each having generatrices (49, 50) oriented parallel to the rotation axis (8), in the vicinity of an end portion (11) of the control shaft (10) there is included a trunnion provided with the external toothing (12), the cam (6) that can be driven by means of the control shaft (10) is provided with the internal toothing (36), and the external toothing (12) and the internal toothing (36) can be inserted, displaced and separated relative to each other in axial direction of the rotation axis (8).

5. The device according to claim 4, characterized in that the cam disk (14) is at the control shaft (10) and the control shaft (10) is at the device, in each case so as to be rotatable about the rotation axis (8) and yet fixed in axial direction in respect of each other, while the auxiliary shaft (32) is at the device so as to be both rotatable about the rotation axis (8) and displaceable in axial direction.

6. The device according to claim 5, characterized in that the auxiliary shaft (32) is supported by means of a spring element (56) at a housing portion (44) that is fixed at the device, projecting from the housing portion (44) and spring-loaded by the spring element (56) towards the control shaft (10).

7. The device according to claim 6, characterized in that the cam disk (14) is an eccentric cylinder arranged at the control shaft (10).

8. The device according to claim 6, characterized in that one of the cams (7) has a root portion (62) for limiting a rotation thereof about the rotation axis (8) in cooperation with a stop (63) fixed at the device.

9. The device according to claim 5, characterized in that the cam disk (14) is an eccentric cylinder arranged at the control shaft (10).

10. The device according to claim 5, characterized in that one of the cams (7) has a root portion (62) for limiting a rotation thereof about the rotation axis (8) in cooperation with a stop (63) fixed at the device.

11. The device according to claim 4, characterized in that, of the external toothing (12) and the internal toothing (36), the one longitudinal toothing (36) is provided with a bridgework region (58) in which a plurality of teeth appear to be fused together from tip to tip when viewed in cross-section, this one longitudinal toothing (36) thus being provided with a filling, and the other longitudinal toothing (12) is provided with a teeth gap region (59) in which a plurality of teeth have been omitted from root to root when viewed in cross-section, this other longitudinal toothing (12) thus being provided with a recess, the bridgework region (58) extending across a smaller number of teeth and thus, with respect to the rotation axis (8), across a circular arc of smaller extent than the teeth gap region (59).

12. The device according to claim 11, characterized in that the cam disk (14) is an eccentric cylinder arranged at the control shaft (10).

13. The device according to claim 11, characterized in that one of the cams (7) has a root portion (62) for limiting a rotation thereof about the rotation axis (8) in cooperation with a stop (63) fixed at the device.

14. The device according to claim 4, characterized in that the cam disk (14) is an eccentric cylinder arranged at the control shaft (10).

15. The device according to claim 4, characterized in that one of the cams (7) has a root portion (62) for limiting a rotation thereof about the rotation axis (8) in cooperation with a stop (63) fixed at the device.

16. The device according to claim 3, characterized in that the cam disk (14) is an eccentric cylinder arranged at the control shaft (10).

17. The device according to claim 3, characterized in that one of the cams (7) has a root portion (62) for limiting a rotation thereof about the rotation axis (8) in cooperation with a stop (63) fixed at the device.

18. The device according to claim 2, characterized in that the cam disk (14) is an eccentric cylinder arranged at the control shaft (10).

19. The device according to claim 2, characterized in that one of the cams (7) has a root portion (62) for limiting a rotation thereof about the rotation axis (8) in cooperation with a stop (63) fixed at the device.

20. The device according to claim 1, characterized in that the cam disk (14) is an eccentric cylinder arranged at the control shaft (10).

21. The device according to claim 1, characterized in that one of the cams (7) has assigned thereto a root portion (62) for limiting a rotation thereof about the rotation axis (8) in cooperation with a stop (63) fixedly arranged at the device.

* * * * *

UNITED STATES PATENT AND TRADEMARK OFFICE

CERTIFICATE OF CORRECTION

PATENT NO. : 6,463,847 B1
DATED : October 15, 2002
INVENTOR(S) : Manfred Rauch

It is certified that error appears in the above-identified patent and that said Letters Patent is hereby corrected as shown below:

Column 2,
Line 7, delete “followings” and insert -- following --.
Line 42, delete “With” and insert -- with --.
Line 50, delete “cross-sectional” and insert -- cross-section --.

Column 6,
Line 18, after “jaw” second occurrence, insert -- 3 --.

Signed and Sealed this

Twenty-second Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,463,847 B1
DATED : October 15, 2002
INVENTOR(S) : Manfred Rauch

It is certified that error appears in the above-identified patent and that said Letters Patent is hereby corrected as shown below:

Title page,
Item, [73], change the Foreign Application Priority Data for the Swiss application from "Jul. 30, 1997" to -- Jul. 23, 1997 --.

Signed and Sealed this

Fifteenth Day of July, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,463,847 B1
DATED : October 15, 2002
INVENTOR(S) : Manfred Rauch

It is certified that error appears in the above-identified patent and that said Letters Patent is hereby corrected as shown below:

Title page,
Item [22], PCT Filed, change "Jun. 18, 1998" to -- Jun. 8, 1998 --.

Signed and Sealed this

Fifteenth Day of February, 2005

JON W. DUDAS
*Director of the United States Patent and Trademark Office*